US011708620B2

(12) United States Patent
Kuwayama

(10) Patent No.: US 11,708,620 B2
(45) Date of Patent: Jul. 25, 2023

(54) FAR-INFRARED RADIATION MULTI-STAGE TYPE HEATING FURNACE FOR STEEL SHEETS FOR HOT STAMPING

(71) Applicants: NIPPON STEEL & SUMIKIN TEXENG. CO., LTD., Tokyo (JP); SHOWA MANUFACTURING CO., LTD., Fukuoka (JP)

(72) Inventor: Shinjiro Kuwayama, Tokyo (JP)

(73) Assignee: NIPPON STEEL & SUMIKIN TEXENG. CO., LTD., Tokyo (JP)

( * ) Notice: Subject to any disclaimer, the term of this patent is extended or adjusted under 35 U.S.C. 154(b) by 859 days.

(21) Appl. No.: 15/316,245

(22) PCT Filed: May 28, 2015

(86) PCT No.: PCT/JP2015/065411
§ 371 (c)(1),
(2) Date: Dec. 5, 2016

(87) PCT Pub. No.: WO2015/186601
PCT Pub. Date: Dec. 10, 2015

(65) Prior Publication Data

US 2017/0159141 A1 Jun. 8, 2017

(30) Foreign Application Priority Data

Jun. 6, 2014 (JP) ..... 2014-117879

(51) Int. Cl.
*C21D 1/34* (2006.01)
*F27B 5/06* (2006.01)
(Continued)

(52) U.S. Cl.
CPC ..... *C21D 1/34* (2013.01); *C21D 9/46* (2013.01); *F27B 5/02* (2013.01); *F27B 5/06* (2013.01);
(Continued)

(58) Field of Classification Search
CPC ... C21D 9/46; C21D 1/00; C21D 1/34; C21D 9/00; B21D 22/022; B21D 22/20;
(Continued)

(56) References Cited

U.S. PATENT DOCUMENTS 2,483,968 A * 10/1949 Ecklund ..... C21D 9/0006 110/176
3,131,919 A * 5/1964 Hartley ..... C21D 1/74 432/131
(Continued)

FOREIGN PATENT DOCUMENTS

CN 1164276 A 11/1997
CN 102564117 A 7/2012
(Continued)

OTHER PUBLICATIONS

Ichikawa, Machine Translation of JP2014034689A, Feb. 24, 2014 (Year: 2014).*
(Continued)

*Primary Examiner* — William J Levicky
*Assistant Examiner* — Adam M Eckardt
(74) *Attorney, Agent, or Firm* — Birch, Stewart, Kolasch & Birch, LLP

(57) ABSTRACT

Steel sheets for hot stamping accommodated in a far-infrared radiation multi-stage type heating furnace are stably supported over a long period of time using steel sheet support members having a small projected area and inhibited from thermally deforming. The far-infrared radiation multi-stage type heating furnace includes: heating units and a ceiling unit arranged in a vertical direction with multiple stages to accommodate aluminum-coated steel sheets or zinc- coated steel sheets for hot stamping; and far-infrared radiation heaters disposed within the heating units and the ceiling unit to heat the steel sheets for hot stamping to a
(Continued)

temperature ranging from the $Ac_3$ transformation temperature to 950° C. Steel sheet support members are mounted to the heating units to support the steel sheets for hot stamping by point contact or line contact with the steel sheets for hot stamping.

21 Claims, 6 Drawing Sheets

(51) Int. Cl.

| | |
|---|---|
| ***F27B 5/02*** | (2006.01) |
| ***F27D 5/00*** | (2006.01) |
| ***C21D 9/46*** | (2006.01) |
| ***F27B 9/06*** | (2006.01) |
| ***F27D 11/12*** | (2006.01) |
| ***H05B 3/00*** | (2006.01) |

(52) U.S. Cl.
CPC ..... *F27B 9/068* (2013.01); *F27D 5/0006* (2013.01); *F27D 11/12* (2013.01); *H05B 3/009* (2013.01)

(58) Field of Classification Search
CPC ..... B21D 24/00; F27B 17/0016; F27B 5/02; F27B 5/06; F27B 9/068; F27B 9/06; F27D 5/00; F27D 11/12; F27D 5/0006; H05B 3/0061; H05B 3/06; H05B 3/66; H05B 3/009; H05B 3/00
USPC ..... 423/253, 261; 392/339, 340, 341, 411; 219/391, 411, 522, 523
See application file for complete search history.

(56) References Cited

U.S. PATENT DOCUMENTS

| | | | | |
|---|---|---|---|---|
| 5,836,760 | A | 11/1998 | Turner et al. | |
| 9,127,886 | B2 * | 9/2015 | Hayashi | F27B 9/021 |
| 10,041,733 | B2 * | 8/2018 | Banik | F27B 9/02 |
| 2001/0038002 | A1 | 11/2001 | Kano et al. | |
| 2007/0257407 | A1 | 11/2007 | Danger et al. | |
| 2012/0315592 | A1 * | 12/2012 | Adelbert | F27B 19/02 432/239 |
| 2013/0273486 | A1 * | 10/2013 | Dvorak | F27D 7/00 432/9 |
| 2014/0099590 | A1 * | 4/2014 | Hayashi | F27B 9/028 432/235 |
| 2016/0195332 | A1 * | 7/2016 | Ban | C21D 9/0018 118/58 |

FOREIGN PATENT DOCUMENTS

| | | | | |
|---|---|---|---|---|
| DE | 102010064605 | B3 | | 7/2017 |
| JP | 10-503581 | A | | 3/1998 |
| JP | 3056522 | U | * | 2/1999 |
| JP | 2007-298270 | A | | 11/2007 |
| JP | 2008-291284 | A | | 12/2008 |
| JP | 2008-296237 | A | | 12/2008 |
| JP | 5197859 | B1 | | 5/2013 |
| JP | 2014-034689 | A | | 2/2014 |
| JP | 2014034689 | A | * | 2/2014 |

OTHER PUBLICATIONS

Japanese Patent Publication JP3056522U; Feb. 26, 1999; with machine english translation from J-PlatPat (Year: 1999).*
Canadian Office Action for corresponding Application No. 2,950,882, dated Jan. 12, 2018.
Chinese Office Action and Search Report for corresponding Application No. 201580039636.X, dated Nov. 27, 2017.
International Search Report (PCT/ISA/210) issued in PCT/JP2015/065411, dated Aug. 25, 2015.
Written Opinion (PCT/ISA/237) issued in PCT/JP2015/065411, dated Aug. 25, 2015.
Chinese Office Action dated Jul. 5, 2018, issued in corresponding Chinese Patent Application No. 201580039636.X.
Extended European Search Report, dated Mar. 26, 2018, for corresponding European Application No. 15803792.9.
Japanese Office Action for Japanese Application No. 2015-544255, dated Jan. 26, 2016, with an English translation.
European Search Report dated Sep. 11, 2019 in corresponding European Patent Application No. 15 803 792.9.

* cited by examiner

FAR-INFRARED RADIATION MULTI-STAGE TYPE HEATING FURNACE FOR STEEL SHEETS FOR HOT STAMPING

TECHNICAL FIELD

The present invention relates to far-infrared radiation multi-stage type heating furnace for steel sheets for hot stamping, and in particular to a far-infrared radiation multi-stage type heating furnace for steel sheets for hot stamping capable of heating the steel sheets for hot stamping to a temperature for example ranging from the $Ac_3$ temperature to 950° C.

BACKGROUND ART

High strength steel sheets are widely used as a blank for making components of an automobile body in order to achieve both a further improvement in the strength, stiffness, and collision safety of the automobile body and an improvement in the fuel economy resulting from the reduced weight of the body. However, the press-formability of steel sheets decreases with increasing strength. As a result, high strength press-formed articles having a desired shape may not be produced.

In recent years, hot press-forming methods (also referred to as hot stamping methods) have been utilized as methods for press-forming components of an automobile body. In hot press-forming methods, a steel sheet (blank) for hot stamping to be press-formed is heated to a temperature equal to or greater than the $Ac_3$ temperature, and immediately after that, is subjected to forming and rapid cooling by a pressing die to be quenched (also referred to as die quenching). In this manner, high strength press-formed articles having a desired shape are produced.

Production of high strength hot press-formed articles in large volumes by a hot press-forming method requires use of a heating furnace for heating steel sheets for hot stamping. Inventions relating to such heating furnaces have been proposed heretofore.

Patent Document 1 discloses a multi-stage heating furnace. The multi-stage heating furnace includes a plurality of accommodation spaces for accommodating a plurality of steel sheets for hot stamping. The plurality of accommodation spaces are aligned in a vertical direction so as to be horizontal to each other. Means for transferring the steel sheets for hot stamping during heating are provided in the plurality of accommodation spaces.

Patent Document 2 discloses a multi-stage heating furnace that includes a box-shaped body and a heat source. Heating chambers are formed within the body. The heat source heats the insides of the chambers to about 900° C. This multi-stage heating furnace is capable of heating a plurality of steel sheets for hot stamping simultaneously and discharging the heated steel sheets for hot stamping separately.

Patent Document 3 discloses a multi-stage heating furnace that includes a body. Heating chambers to be heated by heat sources are provided within the body. Multiple-staged openings arranged in a vertical direction are provided in the front wall of the body. An opening and closing door is provided for each opening at each stage.

Furthermore, Patent Document 4 discloses a heat treatment method. The heat treatment method includes a first step and a second step. In the first step, a steel sheet for hot stamping is heated to an alloying temperature. In the second step, a first region of the steel sheet for hot stamping is held at a temperature equal to or greater than the $A_3$ transformation temperature utilizing thermal energy imparted in the first step while depriving a second region of the steel sheet for hot stamping of thermal energy. As a result, the second region of the steel sheet for hot stamping cools to a temperature equal to or less than the $A_1$ transformation temperature. This heat treatment method can effectively utilize thermal energy imparted in the alloying process and shorten the time for heat treatment.

The heating furnaces disclosed by Patent Documents 1 to 4 use a gas burner, an electric coil heater, a radiant tube, an electromagnetic heater, or another type of heater as the heat source for steel sheets for hot stamping.

These heating furnaces need to meet the following requirements: rapid and uniform heating of the steel sheet for hot stamping over all regions to a high temperature range of equal to or greater than the $Ac_3$ temperature (e.g., from 850 to 950° C.); an improvement in the ability for mass production; and minimization of the area for installation. In recent years, heating furnaces utilizing a far-infrared radiation heater as its heat source have been increasingly used. Heating furnaces of this type have the characteristics a to c listed below:

(a) capable of uniformly heating a steel sheet for hot stamping;

(b) capable of being compact by virtue of the vertically extending multi-stage configuration; and (c) having a thin planar shape and being capable of heating a steel sheet for hot stamping at both sides thereof.

Patent Document 5 discloses a multi-stage heating furnace using a flexible far-infrared radiation heater as its heat source. The flexible far-infrared radiation heater is constructed of numerous insulators arranged in rows and knitted together to form a flexible panel. The numerous insulators have slits for receiving a resistive heating conductor. A heating conductor that emits far-infrared radiation is inserted and provided in the slits.

LIST OF PRIOR ART DOCUMENTS

Patent Document

Patent Document 1: JP2007-298270A
Patent Document 2: JP2008-291284A
Patent Document 3: JP2008-296237A
Patent Document 4: JP5197859B
Patent Document 5: JP2014-34689A

SUMMARY OF INVENTION

Technical Problem

The present inventor conducted research and found that, when the multi-stage heating furnace for steel sheets for hot stamping disclosed in Patent Document 5 is operated, steel sheet support members for supporting the steel sheets for hot stamping during heating deflect at an early stage after start of operation and therefore are unable to support the steel sheets for hot stamping stably over a long period of time.

The present invention is intended to provide a far-infrared radiation multi-stage type heating furnace for steel sheets for hot stamping capable of solving such problems of the conventional art.

Solution to Problem

The present inventor conducted intense research on the cause of deflection of steel sheet support members and consequently ascertained two major causes.

One of the causes is the occurrence of thermal ratchet deformation, in which plastic deformation accumulates in a manner like that of a ratchet. Thermal ratchet deformation is a phenomenon in which, when a large thermal stress cycle involving plastic deformation is repeatedly applied to a member under static stress, progressive non-elastic deformation accumulates in a certain direction depending on the directions and magnitudes of the stresses. This phenomenon is attributable to restraint of the steel sheet support member at two points in the longitudinal direction. When a steel sheet support member is restrained at two points in the longitudinal direction, it cannot expand freely by thermal expansion and therefore compressive thermal stress occurs in the steel sheet support member. As a result, the steel sheet support member plastically deforms. When a steel sheet support member has a large elongation, it deflects to an arc shape. Steel sheet support members undergo repeated compression and extension due to repeated temperature increase and decrease in the furnace body. In this manner, thermal ratchet deformation occurs in the steel sheet support member.

The other cause is the occurrence of a high-temperature creep strain phenomenon. Consider a case in which a steel sheet support member is not secured at two points in the longitudinal direction and is able to, at least at one end, expand and contract freely in the longitudinal direction of the support member. Even in such a case, a high-temperature creep strain phenomenon occurs in which deflection progresses in accordance with the length of time during which the steel sheet for hot stamping is exposed to high temperature, which is necessary for quenching the steel sheet for hot stamping. A high-temperature creep strain phenomenon occurs even in a case in which the bending stress due to the weight of the steel sheet for hot stamping or the steel sheet support members is very small or in a case in which the temperature is uniform and constant.

The present inventor conducted further research and consequently made the findings A to E listed below to accomplish the present invention.

(A) Steel sheet support members are to be mounted without being restrained at two points in the longitudinal direction thereof or at least at one of the ends without being restrained in the longitudinal direction. This will allow the steel sheet support members to expand freely in the longitudinal direction while thermal expansion of the steel sheet support members is not interfered with. Thus, it is possible to minimize thermal stress that occurs in the steel sheet support members and therefore to reduce the occurrence of thermal ratchet deformation.

(B) In order to minimize high-temperature creep strain, it is desirable to reduce the level of bending stress due to the weight of the steel sheet for hot stamping and to increase the section modulus per weight of the steel sheet support member.

(C) In order to significantly reduce the maintenance cost, it is desirable to form the steel sheet support members from a material having a low high-temperature creep strain rate such as Inconel.

(D) In order to ensure heating uniformity and temperature controllability, it is desirable to configure the steel sheet support members so that the projected area thereof is as small as possible.

(E) When the steel sheet for hot stamping is an aluminum-coated steel sheet or a zinc-coated steel sheet, it is desirable that the contact area between the support members for a steel sheet for hot stamping and the steel sheet for hot stamping is as small as possible, as in the case of point contact or line contact for example.

The present invention is as set forth below.

(1) A far-infrared radiation multi-stage type heating furnace for steel sheets for hot stamping, the far-infrared radiation heating furnace including heating units and steel sheet support members, the heating units including blocks made of a thermal insulation material, the blocks being disposed around horizontal planes of spaces for accommodating the steel sheets for hot stamping and far-infrared radiation heaters positioned above and below the steel sheets for hot stamping to heat the steel sheets for hot stamping, the steel sheet support members being disposed within the heating units to support the steel sheets for hot stamping, the far-infrared radiation heating furnace further including support pieces that support the steel sheet support members in such a manner that the steel sheet support members are expandable and contractible in a longitudinal direction by thermal expansion or thermal contraction.

(2) The far-infrared radiation multi-stage type heating furnace according to item (1) for steel sheets for hot stamping, wherein each of the far-infrared radiation heaters is a planar structure formed of a plurality of insulator elements arranged in rows, the insulator elements being made of sintered form of far-infrared radiation emitting ceramics, and wherein the plurality of insulator elements are coupled together by a heating wire so as to be capable of being displaced from each other so that the far-infrared radiation heater has flexibility, the heating wire being inserted in heating wire through holes formed in the respective insulator elements.

(3) The far-infrared radiation multi-stage type heating furnace according to item (1) or (2) for steel sheets for hot stamping, wherein the steel sheet support members are made of a heat resistant alloy.

(4) The far-infrared radiation multi-stage type heating furnace according to any one of items (1) to (3) for steel sheets for hot stamping, wherein the steel sheets for hot stamping are aluminum-coated steel sheets or zinc-coated steel sheets and wherein the steel sheet support members support the steel sheets for hot stamping by point contact or line contact with the steel sheets for hot stamping.

(5) The far-infrared radiation multi-stage type heating furnace according to item (4) for steel sheets for hot stamping, wherein the steel sheet support members that provide a point contact with the steel sheets for hot stamping are rectangular tubes, strips or round tubes, disposed in a laterally vertical position and each having upright pins on a surface thereof, or round tubes having a wire wound around a outer circumferential surface thereof.

(6) The far-infrared radiation multi-stage type heating furnace according to item (4) for steel sheets for hot stamping, wherein the steel sheet support members that provide a line contact with the steel sheets for hot stamping are rectangular bars or strips, disposed in a laterally vertical position and each having an acute angle portion on a surface thereof.

Advantageous Effects of the Invention

The present invention prevents steel sheet support members that support steel sheets for hot stamping from deflecting at an early stage after start of operation and therefore achieves stable support of the steel sheets for hot stamping over a long period of time. This enables a significant reduction in the maintenance cost of the far-infrared radiation multi-stage type heating furnace for steel sheets for hot stamping, an improvement in capacity utilization of the far-infrared radiation multi-stage type heating furnace for steel sheets for hot stamping, and an improvement in heating uniformity of the steel sheets for hot stamping, and further, size reduction of the far-infrared radiation multi-stage type heating furnace by virtue of the multi-stage configuration.

In addition, in the case where the steel sheet for hot stamping is an aluminum-coated steel sheet, adherence of the coating to the steel sheet support members is prevented by virtue of the reduced contact area and therefore retention of the coating film is achieved. In the case where the steel sheet for hot stamping is a zinc-coated steel sheet, dispersion of the coating is prevented by virtue of the reduced contact area and therefore retention of the coating is achieved.

BRIEF DESCRIPTION OF THE DRAWINGS

FIG. 1(*b*) is a front view of the insulator element; FIG. 1(*c*) is a plan view of the flexible far-infrared radiation heater; FIG. 1(*d*) is a front view illustrating an array of insulators knitted together to look like a bamboo blind with a heating wire passed therethrough; FIG. 1(*e*) is a side view of FIG. 1(*c*); and FIG. 1(*f*) is an illustration of the insulator elements arranged such that adjacent rows are offset by half the length of the preceding row.

FIG. 3(*a*) is an illustration of the exterior of the far-infrared radiation multi-stage type heating furnace; FIG. 3(*b*) is an illustration of a heating unit; FIG. 3(*c*) is a cross-sectional view taken along the line A-A of FIG. 3(*b*); FIG. 3(*d*) is an illustration of the heating unit with its cover block removed; FIG. 3(*e*) is a cross-sectional view taken along the line B-B of FIG. 3(*b*); and FIG. 3(*f*) is a perspective view of a steel sheet support member.

FIG. 6(*b*) is a top view of the heating unit; FIG. 6(*c*) is an illustration depicting a positional relationship between the heater and the steel sheet for hot stamping; and FIG. 6(*d*) is an illustration of an alternative heater support member in a heating unit.

FIG. 7(*b*) is a cross-sectional view of the steel sheet support member; and FIGS. 7(*c*) to 7(*f*) are each an illustration of an alternative example.

DESCRIPTION OF EMBODIMENTS

The present invention will be described with reference to the accompanying drawings.

1. Configuration of Furnace Body Frame 12

Figure 2:
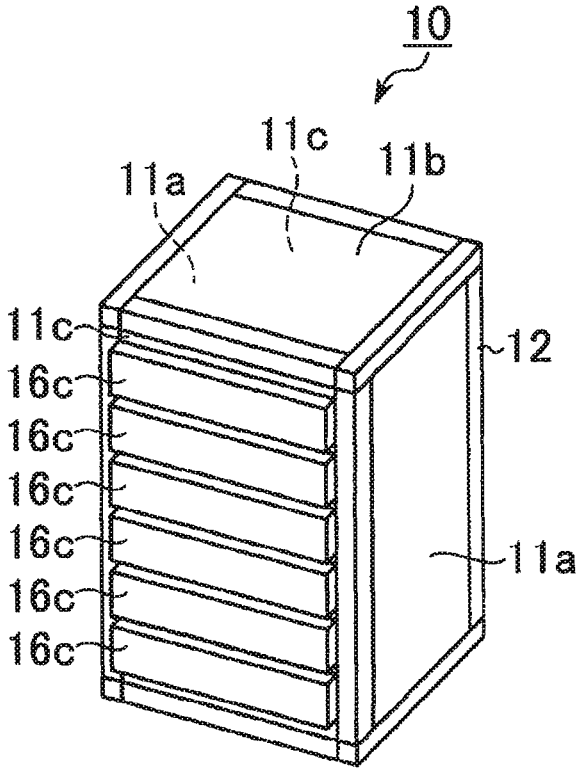
FIG. 2 is an overall view of a far-infrared radiation multi-stage type heating furnace according to the present invention.

FIG. 2 is an overall view of a far-infrared radiation multi-stage type heating furnace 10 according to the present invention, illustrating exterior panels 11*a*, 11*b*, 11*c* and a furnace body frame 12.

Figure 3:
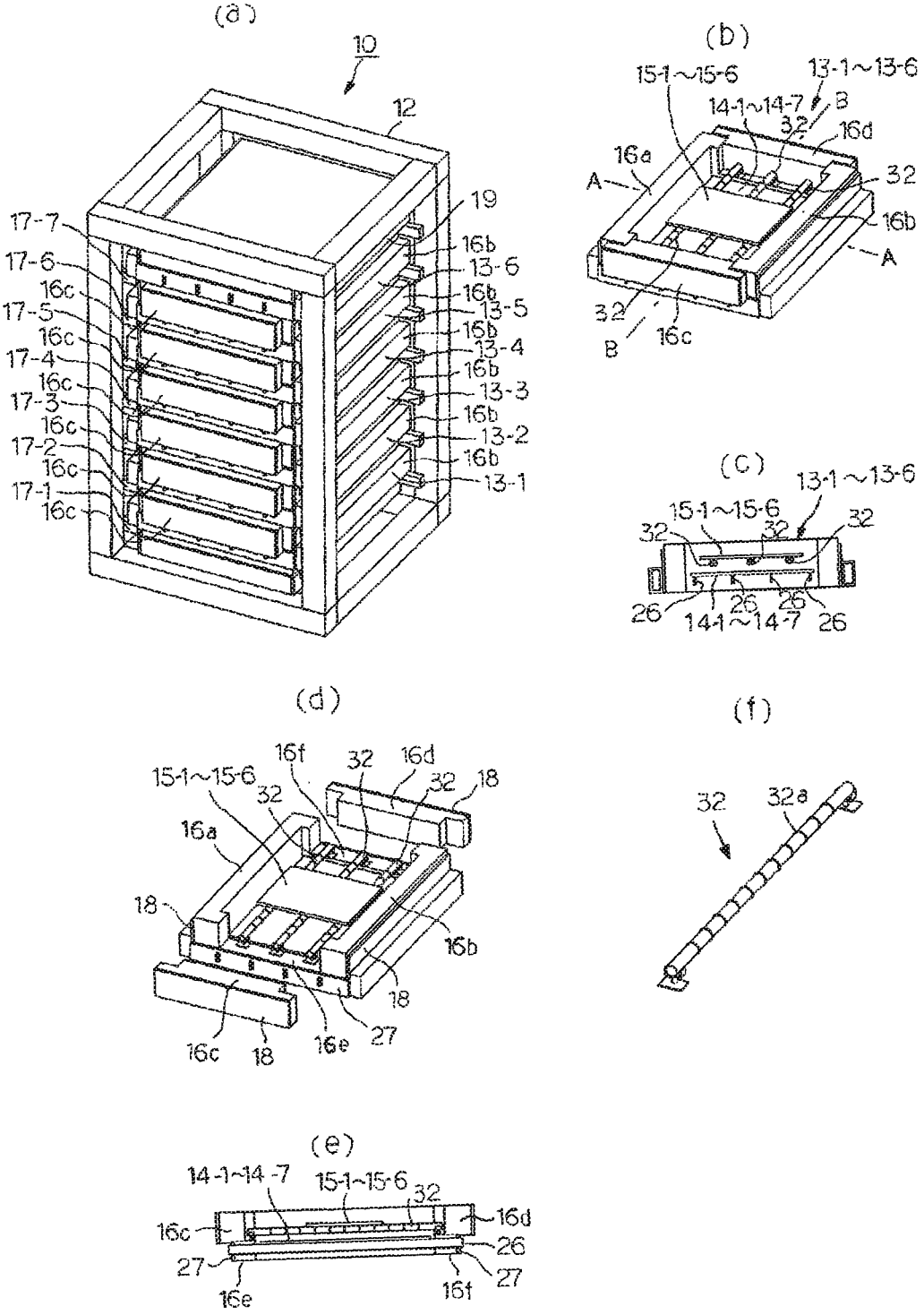
FIG. 3 presents illustrations of the far-infrared radiation multi-stage type heating furnace according to the present invention.

FIG. 3 presents illustrations of the far-infrared radiation multi-stage type heating furnace 10 according to the present invention. FIG. 3(*a*) is an illustration of the exterior of the far-infrared radiation multi-stage type heating furnace 10, FIG. 3(*b*) is an illustration of heating units 13-1 to 13-6, FIG. 3(*c*) is a cross-sectional view taken along the line A-A of FIG. 3(*b*), FIG. 3(*d*) is an illustration of the heating units 13-1 to 13-6 with the cover blocks 16*c*, 16*d* removed, FIG. 3(*e*) is a cross-sectional view taken along the line B-B of FIG. 3(*b*), and FIG. 3(*f*) is a perspective view of a steel sheet support member 32.

Figure 4:
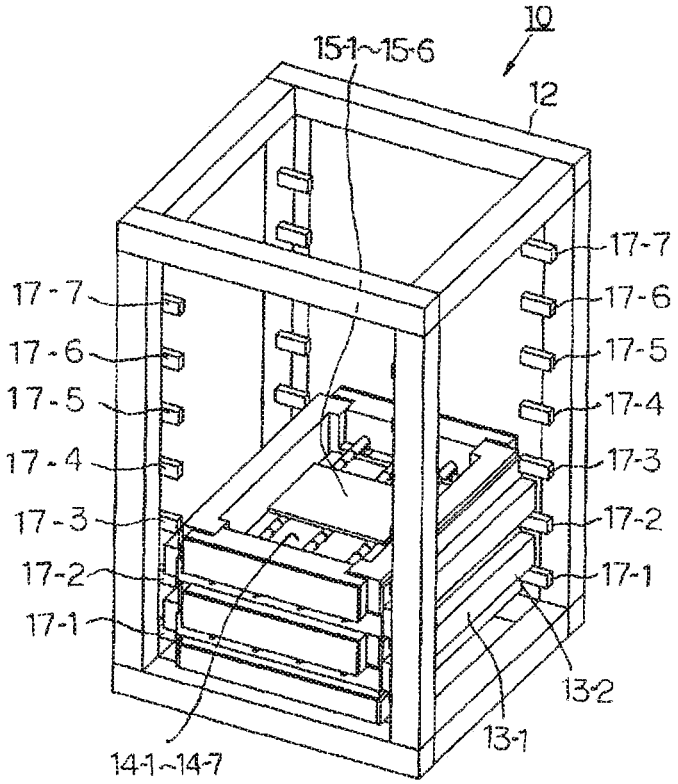
FIG. 4 is an illustration of the far-infrared radiation multi-stage type heating furnace.
Figure 5:
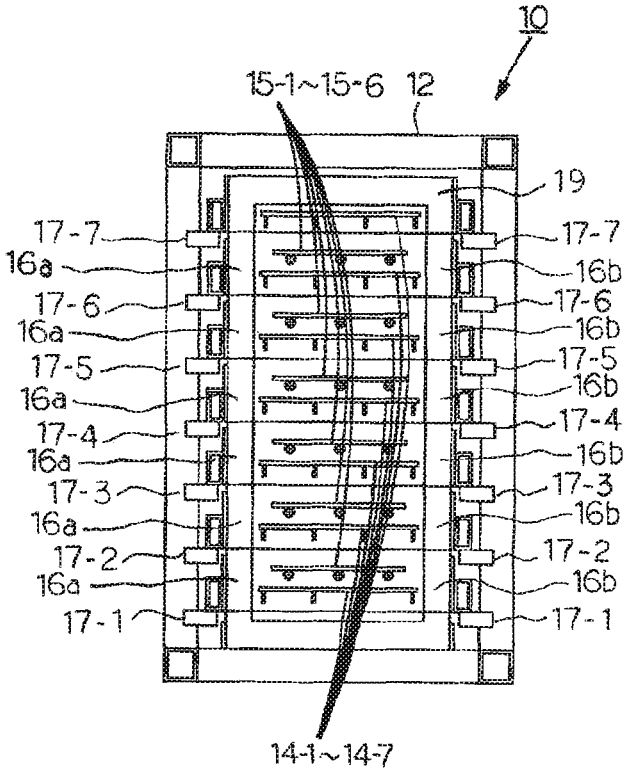
FIG. 5 is a front view of the far-infrared radiation multi-stage type heating furnace with a ceiling unit illustrated therein.

FIG. 4 is an illustration of the far-infrared radiation multi-stage type heating furnace 10 with only the heating units 13-1, 13-2 illustrated therein. FIG. 5 is a front view of the far-infrared radiation multi-stage type heating furnace 10 with a ceiling unit 19 illustrated therein.

As illustrated in FIGS. 2 to 5, the far-infrared radiation multi-stage type heating furnace 10 includes heating units 13-1 to 13-6, the ceiling unit 19, and the furnace body frame 12.

The heating units 13-1 to 13-6 each have a space for accommodating steel sheets for hot stamping 15-1 to 15-6, respectively. The space is formed by blocks 16*a*, 16*b*, 16*c*, 16*d*, 16*e*, 16*f* made of a thermal insulation material that are disposed around the space. The heating units 13-1 to 13-6 respectively accommodate steel sheets for hot stamping 15-1 to 15-6 supported approximately horizontally within the spaces.

The heating units 13-1 to 13-6 are a plurality of (six in the case of the far-infrared radiation multi-stage type heating furnace 10 illustrated in FIGS. 2 to 5) heating units that are stacked in a vertical direction.

The heating units 13-1 to 13-6 include far-infrared radiation heaters 14-1 to 14-6, respectively, and the ceiling unit 19 includes a far-infrared radiation heater 14-7. The far-infrared radiation heaters 14-1 to 14-7 are positioned above and below the steel sheets for hot stamping 15-1 to 15-6 accommodated in the spaces. Specifically, the far-infrared radiation heaters 14-1, 14-2 are respectively positioned above and below the steel sheet for hot stamping 15-1, the far-infrared radiation heaters 14-2, 14-3 are respectively positioned above and below the steel sheet for hot stamping 15-2, the far-infrared radiation heaters 14-3, 14-4 are respectively positioned above and below the steel sheet for hot stamping 15-3, the far-infrared radiation heaters 14-4, 14-5 are respectively positioned above and below the steel sheet for hot stamping 15-4, the far-infrared radiation heaters 14-5, 14-6 are respectively positioned above and below the steel sheet for hot stamping 15-5, and the far-infrared radiation heaters 14-6, 14-7 are respectively positioned above and below the steel sheet for hot stamping 15-6.

Thus, the far-infrared radiation heaters 14-1 to 14-7 heat corresponding ones of the steel sheets for hot stamping 15-1 to 15-6 from above and below to a temperature ranging from the $Ac_3$ transformation temperature to 950° C. for example.

The far-infrared radiation heaters 14-1 to 14-7 are flexible planar far-infrared radiation heaters (hereinafter also referred to as "flexible far-infrared radiation heater") as disclosed in Japanese Registered Utility Model Publication No. 3056522.

Figure 1:
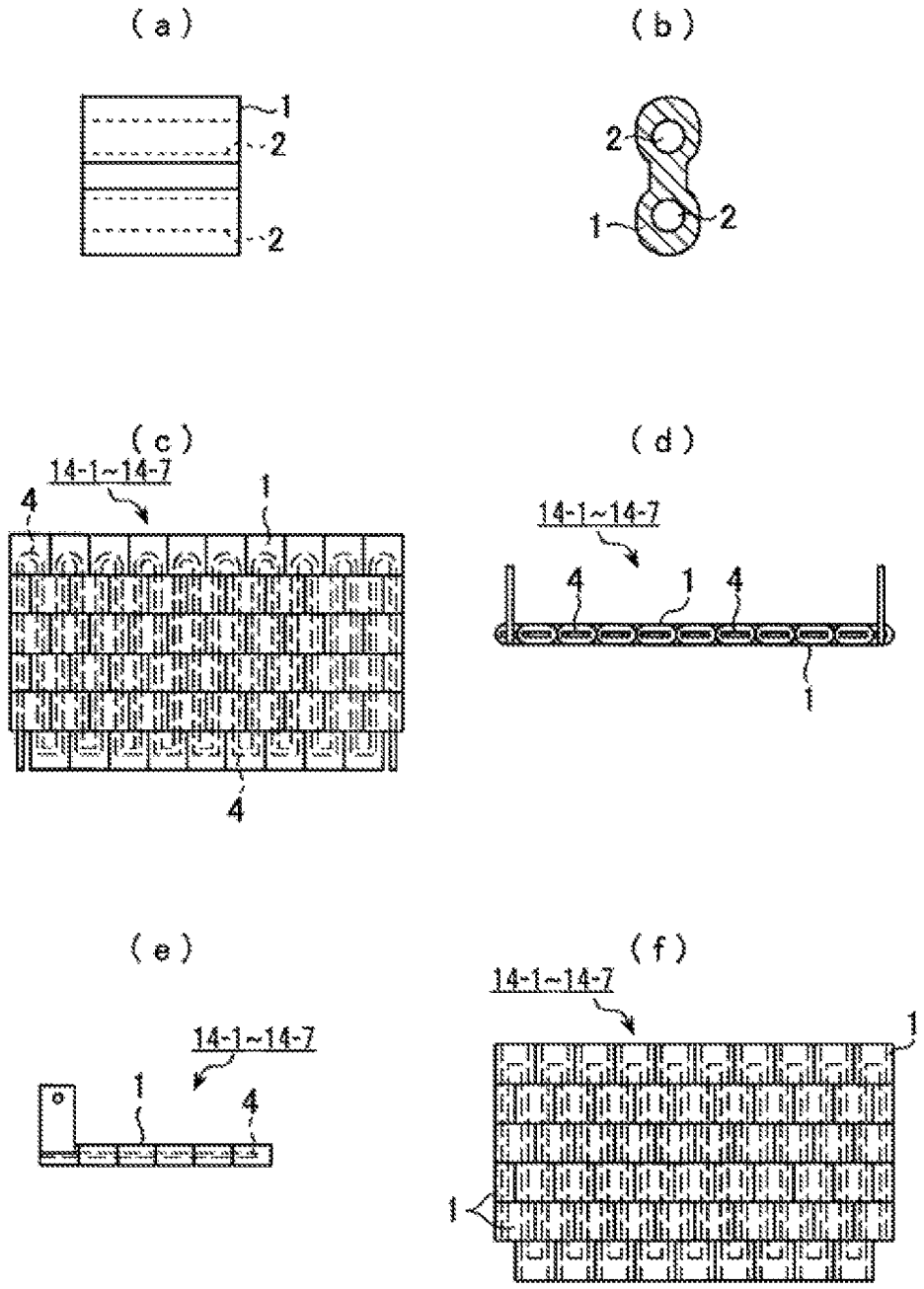
FIG. 1(*a*) is a plan view of an insulator element used in a flexible far-infrared radiation heater.

The far-infrared radiation heaters 14-1 to 14-7 includes insulator elements 1 as illustrated in FIGS. 1(*a*) to 1(*f*). The insulator elements 1 are made of sintered form of far-infrared radiation emitting ceramics such as for example $Al_2O_3$, $SiO_2$, $ZrO_2$, $TiO_2$, SiC, CoO, $Si_3N_4$. The far-infrared radiation heaters 14-1 to 14-7 are each a planar structure formed of a plurality of insulator elements 1 arranged in rows. The plurality of insulator elements 1 are coupled together so as to be capable of being displaced from each other by a heating wire 4 inserted in heating wire through holes 2 formed in the respective insulator elements 1. The far-infrared radiation heaters 14-1 to 14-7 are flexible far-infrared radiation heaters having flexibility.

The far-infrared radiation heaters 14-1 to 14-7 generate heat from the inside of the insulator elements 1 upon application of current through the heating wire provided within the insulator elements 1. As a result, a high rate of temperature increase is achieved in the far-infrared radiation heaters 14-1 to 14-7. The far-infrared radiation heaters 14-1 to 14-7 are capable of performing heating at both sides thereof and therefore achieve reduced heat loss. The far-infrared radiation heaters 14-1 to 14-7 emit high-density far-infrared radiation energy and therefore provide for enhanced heating efficiency. The far-infrared radiation heaters 14-1 to 14-7 are flexible, and therefore are less likely to have cracks or deformation at high temperatures and the size thereof can be easily set ranging from a small size to a large size. In addition, the far-infrared radiation heaters 14-1 to 14-7 are thin, and further, capable of heating both sides of the steel sheets for hot stamping 15-1 to 15-6.

Hence, the far-infrared radiation heaters 14-1 to 14-7 are preferable as heaters that are respectively provided in the heating units 13-1 to 13-6 and ceiling unit 19 of the multi-stage heating furnace and required to exhibit high heating efficiency and excellent furnace temperature controllability.

The furnace body frame 12 is a frame made of metal (carbon steel for example) disposed so as to surround the heating units 13-1 to 13-6 and the ceiling unit 19.

As illustrated in FIG. 3(*b*), the spaces of the heating units 13-1 to 13-6 each have an approximately rectangular outer shape in a horizontal plane. The heating units 13-1 to 13-6 each include blocks 16*a*, 16*b*, 16*c*, 16*d*, 16*e*, 16*f* made of a thermal insulation material that surround the periphery of each space in a horizontal plane.

The heating units 13-1 to 13-6 are each constituted by fixed blocks 16*a*, 16*b*, fixed blocks 16*e*, 16*f*, and cover blocks 16*c*, 16*d*. The fixed blocks 16*a*, 16*b* are fixedly placed at two opposing sides of the rectangular shape. The fixed blocks 16*a*, 16*b* have an approximately rectangular solid outer shape. The fixed blocks 16*e*, 16*f* are fixedly placed at the remaining two opposing sides. The fixed blocks 16*e*, 16*f* have an approximately rectangular solid outer shape. The cover blocks 16*c*, 16*d* are disposed to engage with the fixed blocks 16*e*, 16*f* so as to be openable and closable.

Opening and closing of the cover blocks 16*c*, 16*d* is actuated by a suitable opening and closing mechanism (not illustrated). In a closed state the cover blocks 16*c*, 16*d* are in contact with the front faces, upper faces, and lower faces of the fixed blocks 16*e*, 16*f* and end faces in the longitudinal direction of the fixed blocks 16*a*, 16*b*. In this manner, the cover blocks 16*c*, 16*d*, together with the fixed blocks 16*a*, 16*b* and the fixed blocks 16*e*, 16*f* thermally insulate the internal spaces of the heating units 13-1 to 13-6 from the outside.

The heating units 13-1 to 13-6 each include metal (steel for example) furnace shells (iron shells) 18, which surround peripheries of the fixed blocks 16*a*, 16*b* and fixed blocks 16*e*, 16*f* and retain the fixed blocks 16*a*, 16*b* and fixed blocks 16*e*, 16*f*.

Spacers 17-1 to 17-7 made from steel for example are mounted at heights that conform to the placement heights of the heating units 13-1 to 13-6 and ceiling unit 19 in the furnace body frame 12 by suitable means such as for example welding or fastening. It suffices if the spacers 17-1 to 17-7 exhibit heat resistance to a degree sufficient to avoid deformation that may be caused by heat transmitted from the fixed blocks 16*a*, 16*b*, and thus the spacers may be formed from a metal material other than steel.

The fixed blocks 16*a*, 16*b* of the heating units 13-1 to 13-6 and ceiling unit 19 are supported (received) by the spacers 17-1 to 17-7 interposed between them and the furnace body frame 12. The fixed blocks 16*a*, 16*b* are in contact with the spacers 17-1 to 17-7 but not in contact with the furnace body frame 12.

As described above, the heating units 13-1 to 13-6 and ceiling unit 19, which have the spaces in which the ambient temperature reaches 850 to 950° C. during operation, contact the spacers 17-1 to 17-7 but do not contact the furnace body frame 12. As a result, the heat of the heating units 13-1 to 13-6 and ceiling unit 19 does not transfer to the furnace body frame 12. Consequently, thermal expansion of the furnace body frame 12 is prevented.

For example, the amount of displacement of the furnace body frame 12 at the height at the center in the height direction of the uppermost heating unit 13-6 during operation of the far-infrared radiation multi-stage type heating furnace 10 is approximately 0.4 to 0.5 mm. Thus, deformation of the furnace body frame 12 due to thermal expansion is substantially eliminated.

As a result, the furnace body frame 12 is free of thermal stress, and deformation of the furnace body frame 12 due to thermal expansion or thermal contraction, repetitive thermal stress loading, unstable operation, shortened life of the refractories that are the thermal insulation materials 16 and also damages such as cracking of the furnace body frame 12 are prevented. This results in a significant reduction in the maintenance cost and an improvement in capacity utilization of the far-infrared radiation multi-stage type heating furnace 10.

2. Support Members 24-1, 24-2 for Far-Infrared Radiation Heater 14-1

Figure 6:
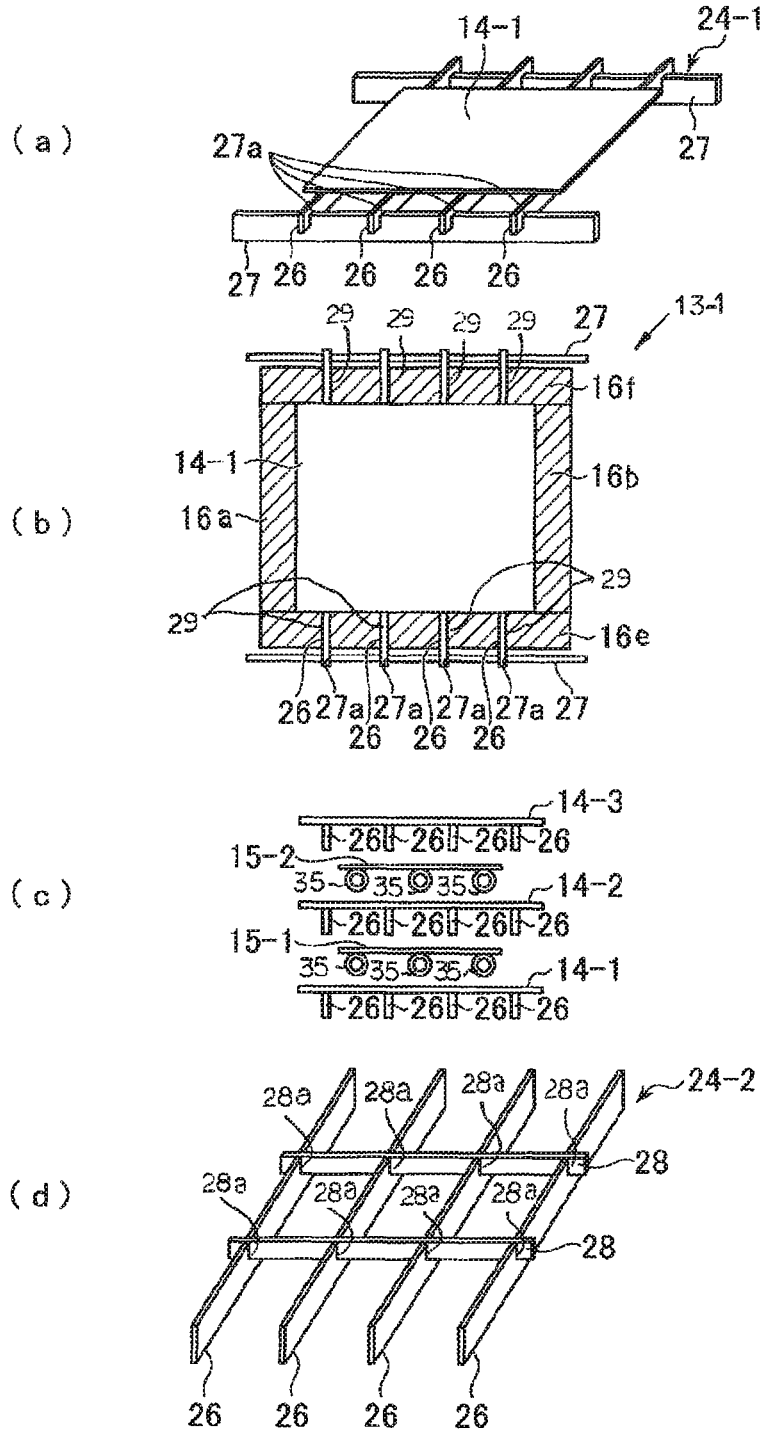
FIG. 6(*a*) is an illustration of a heater support member in a heating unit.

FIG. 6(*a*) is an illustration of a heater support member (hereinafter simply referred to as "support member") 24-1 for the far-infrared radiation heater 14-1 in the heating unit 13-1; FIG. 6(*b*) is a top view of the heating unit 13-1; FIG. 6(*c*) is an illustration depicting a positional relationship between the far-infrared radiation heater 14-1 and the steel sheet for hot stamping 15-1; and FIG. 6(*d*) is an illustration of an alternative support member 24-2 for the far-infrared radiation heater 14-1 in the heating unit 13-1.

As illustrated in FIGS. 6(*a*) to 6(*c*), the far-infrared radiation heater 14-1 is supported by the support member 24-1 horizontally in a manner to prevent deflection. The support member 24-1 is made up of first metal strips 26 and support pieces 27. The first metal strip 26 is formed from a nickel-based heat resistant alloy for example. A plurality of (four in FIGS. 6(*a*) to 6(*d*)) the first metal strips 26 are provided in alignment in a first direction. The support pieces 27 support the first metal strips 26. The support pieces 27 are sheets formed of a stainless steel for example.

As illustrated in FIG. 6(*b*), the far-infrared radiation heater 14-1 is received by the four first metal strips 26 to be disposed approximately horizontally. The far-infrared radiation heater 14-1 is disposed within the region surrounded by the fixed blocks 16*a*, 16*b*, 16*e*, 16*f* in a horizontal plane.

The four first metal strips 26 are all provided such that their strong axis direction (direction in which the flexural rigidity (area moment of inertia and section modulus) is greater) approximately corresponds to the direction of gravity. This minimizes deflection of the first metal strips 26.

The first metal strips 26 are fitted into respective slits or holes 27*a* (slits are illustrated in the figure) formed in the support pieces 27 so as to provide clearance in the slits or holes, and are supported. This configuration allows the first metal strips 26 to be supported by the support pieces 27 so as to be expandable and contractible in a longitudinal direction by thermal expansion or thermal contraction. As a result, the first metal strips 26 are free of thermal stress caused by temperature changes.

Preferably, the first metal strips 26 receive the far-infrared radiation heater 14-1 via an insulating member (made of $Al_2O_3$ for example) having thermally insulating properties and insulating properties. An example of such insulating member is one having a cross sectional shape with a groove and which is attached to the first metal strip 26 by being fitted into the upper end of the first metal strip 26.

FIG. 6(*d*) illustrates an alternative support member 24-2, which may be constituted by a plurality of (two in FIG. 6(*d*)) second metal strips 28 together with the first metal strips 26. The plurality of second metal strips 28 are provided in alignment in a second direction intersecting (orthogonal in the illustrated example) the first direction in which the first metal strips 26 are oriented. The second metal strips 28 are formed of a stainless steel for example.

Similarly to the first metal strips 26, the second metal strips 28 are provided such that their strong axis direction approximately corresponds to the direction of gravity. The second metal strips 28 are fitted into respective slits 28*a* formed in the first metal strips 26 so as to provide clearance in the slits, and are supported. This configuration allows the second metal strips 28 to be supported by the first metal strips 26 so as to be expandable and contractible in a longitudinal direction by thermal expansion or thermal contraction. As a result, the second metal strips 28 are free of thermal stress caused by temperature changes.

As illustrated in FIG. 6(*b*), through holes 29 are formed in the thermal insulation materials 16*e*, 16*f*. The first metal strips 26 pass through the through holes 29 of the thermal insulation materials 16*e*, 16*f* and are supported by the support pieces 27. The support pieces 27 are located outside the steel sheet accommodating regions surrounded by the fixed blocks 16*a*, 16*b*, 16*e*, 16*f*, which are the thermal insulation materials. The outer portions of the first metal strips 26 protruding from the thermal insulation materials 16*e*, 16*f* become hot and therefore preferably a thermal insulation process is applied to the outer portions of the first metal strips 26 by enclosing them with thermal insulation materials or covers for example.

As described above, outside the thermal insulation materials 16*a*, 16*b*, 16*e*, 16*f*, the support pieces 27 support the plurality of first metal strips 26 or the plurality of first metal strips 26 and plurality of second metal strips 28.

The first metal strips 26 (1000 mm in overall length) formed from Inconel (registered trademark) were placed at predetermined locations in the heating unit 13-1 of the far-infrared radiation multi-stage type heating furnace 10 in the manner described above, and the far-infrared radiation multi-stage type heating furnace 10 was used 24 hours a day for one month. The result was that the amount of vertically downward deflection at the longitudinal center of the first metal strips 26 was less than 0.1 mm. This demonstrates that the first metal strips 26 are able to support the far-infrared radiation heater 14-1 sufficiently flatly without causing deflection.

As described above, the support members 24-1, 24-2 are capable of supporting the far-infrared radiation heater 14-1 without causing deflection despite their small projected areas, by means of the first metal strips 26 or by means of the first metal strips 26 and the second metal strips 28, even during heating at 850° C. or above.

Thus, the present invention reduces the frequency or number of times of maintenance of the far-infrared radiation heater 14-1 having flexibility, and thereby achieves all of the following: a significant reduction in the maintenance cost of the far-infrared radiation multi-stage type heating furnace 10; an improvement in capacity utilization of the far-infrared radiation multi-stage type heating furnace 10; retention and improvement of heating uniformity of steel sheets for hot stamping 15-1; and size reduction of the far-infrared radiation multi-stage type heating furnace 10 due to its multi-stage configuration.

In the exemplary embodiment illustrated in FIG. 6(*c*), the steel sheet for hot stamping 15-1 is supported by round tubes 35 in line contact. However, the present invention is not limited to this embodiment. For example, the steel sheet for hot stamping 15-1 may be supported by a variety of below-described steel sheet support members 31 to 34 illustrated in FIGS. 7(*a*) to 7(*f*).

3. Steel Sheet Support Members 30 to 34 for Steel Sheet for Hot Stamping 15-1

Figure 7:
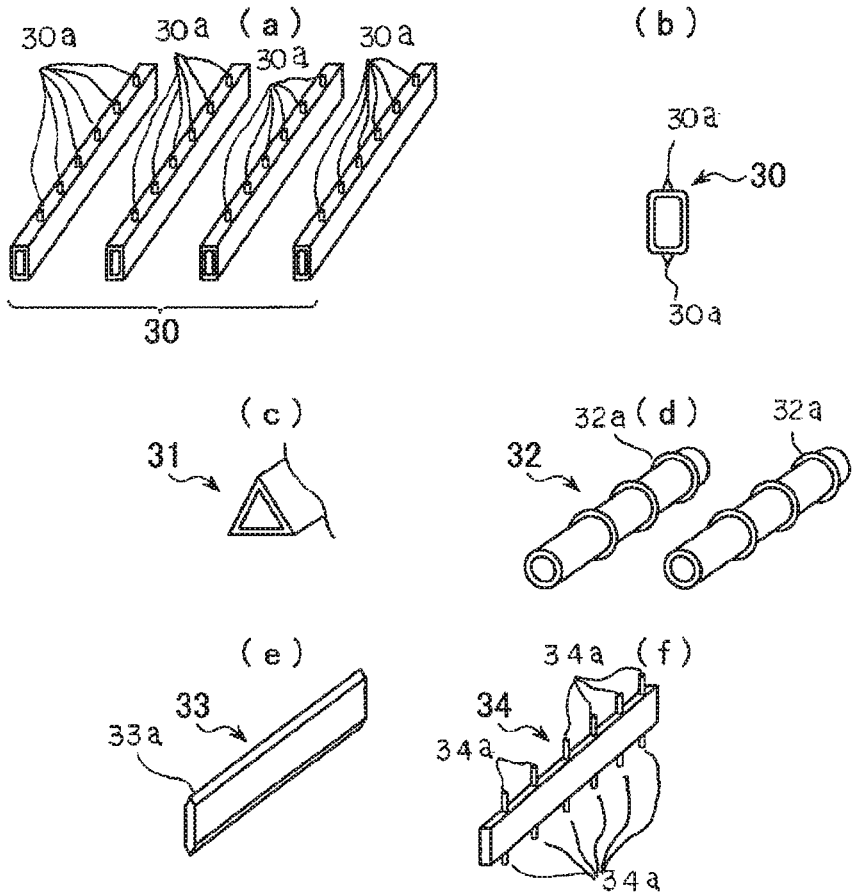
FIG. 7(*a*) is an illustration of an exemplary steel sheet support member.

FIG. 7(*a*) is an illustration of an exemplary steel sheet support member 30; FIG. 7(*b*) is a cross-sectional view of the steel sheet support member 30; and FIGS. 7(*c*) to 7(*f*) are illustrations of alternative exemplary steel sheet support members 31 to 34.

For example, any of the steel sheet support members 30 to 34 each made of a heat resistant alloy can be mounted to the heating unit 13-1 of the far-infrared radiation multi-stage type heating furnace 10. The steel sheet support members 30 to 34 support the steel sheet for hot stamping 15-1 by point contact or by line contact with the steel sheet for hot stamping 15-1.

In the present invention, "point contact" refers to contact by a contact surface, for example of a pin, formed on its front edge and having an outside diameter of approximately 6 mm or less, or contact by the outer circumferential surface for example of a ring having a cross-sectional diameter of approximately 7 mm or less, and "line contact" refers to contact by a contact surface, for example of a sheet, formed on its edge by beveling or other means and having a width of approximately 3 mm or less, contact by the outer circumferential surface of a steel bar having an outside diameter of approximately 6 mm or less, or contact by the outer circumferential surface for example of a thin-wall round tube having an outside diameter of approximately of 20 mm or less. By virtue of the point contact or line contact, dispersion of a coating at the contact region is prevented in the case where the steel sheet for hot stamping is a zinc-coated steel sheet.

Examples of steel sheet support members that provide a point contact with the steel sheet for hot stamping 15-1 include: a rectangular tube 30 in a laterally vertical position having upright pins 30*a* provided on its surface (see FIGS. 7(*a*) and 7(*b*)); a rectangular bar 34 in a laterally vertical position having upright pins 34*a* provided on its surface (see FIG. 7(*f*)); or a round tube 32 having, on its outer circumferential surface, a wire 32*a* of a circular cross section wound therearound (see FIG. 7(*d*)). In these instances, it is preferred that the bodies of the rectangular tube 30 and the rectangular bar 34 are made of a super heat resistant alloy such as Inconel for example and that the pins 30*a*, 34*a* provided on the bodies of the rectangular tube 30 and the rectangular bar 34, respectively, are made of ceramics (e.g., $Al_2O_3$, $SiO_2$, $ZrO_2$, $TiO_2$, SiC, CoO, $Si_3N_4$), which are non-metallic materials, in order to ensure the quality of the steel sheet for hot stamping.

Examples of steel sheet support members that provide a line contact with the steel sheet for hot stamping 15-1 include: a triangular tube 31 having an equilateral triangular cross section (see FIG. 7(*c*)); and a sheet member 33 in a laterally vertical position having an acute angle portion 33*a* disposed on its surface (see FIG. 7(*e*)).

Similarly to the first metal strips 26 and the second metal strips 28, it is preferred that the steel sheet support members 30 to 34 are supported by the support pieces so as to be expandable and contractible in a longitudinal direction by thermal expansion or thermal contraction in order to prevent thermal stress caused by temperature change. For example, the steel sheet support members 30 to 34 are supported by support pieces mounted to the upper surfaces of the thermal insulation materials 16*e*, 16*f* so as to be expandable and contractible in a longitudinal direction by thermal expansion or thermal contraction.

If the steel sheet support members 30 to 34 have been deflected in use, they may be turned upside down and relocated so as to project upwardly.

The rectangular tubes 30 formed from Inconel having a cross-sectional shape as illustrated in FIG. 7(*b*) (800 mm in overall length) were placed as steel sheet support members at predetermined locations in the heating unit 13-1 of the far-infrared radiation multi-stage type heating furnace 10 in the manner described above, and the far-infrared radiation multi-stage type heating furnace 10 was used 24 hours a day for one month. The result was that the amount of vertically downward deflection at the longitudinal center of the rectangular tubes 30 was less than 0.2 mm. This demonstrates that the steel sheet for hot stamping 15-1 can be supported at substantially constant positions.

In addition, the difference between the maximum temperature and the minimum temperature between regions of the steel sheet for hot stamping 15-1, which was heated to 900° C., was approximately 7° C. Thus, sufficiently uniform heating of the steel sheet for hot stamping 15-1 is achieved.

Other steel sheet support members than the steel sheet support members 30 to 34 illustrated in FIGS. 7(*a*) to 7(*f*) may be used. Examples of other steel sheet support members that may be used include: a rectangular tube formed by integrating the pins with the rectangular tube 30 in a laterally vertical position or a rectangular bar formed by integrating the pins with the rectangular bar 34 in a laterally vertical position; a rectangular tube having, on its upper surface and lower surface, alternating recesses and projections that are formed by providing cutouts in parts of the upper surface and lower surface of the rectangular tube 30 in a laterally vertical position; a member having, on its upper surface, alternating recesses and projections that are formed by providing cutouts in parts of the upper surface of a member having a channel-shaped cross section in a laterally vertical position; and a rectangular tube having, on its upper surface and lower surface, successive round holes that are formed by providing round holes in the upper surface and lower surface of the rectangular tube 30 in a laterally vertical position.

The present invention significantly minimizes thermal deformation and other damage to the steel sheet support members 30 to 34. As a result, the present invention achieves a significant reduction in the maintenance cost of the far-infrared radiation multi-stage type heating furnace 10, an improvement in capacity utilization of the far-infrared radiation multi-stage type heating furnace 10 and heating uniformity therein; and size reduction of the far-infrared radiation multi-stage type heating furnace 10 by virtue of the multi-stage configuration.

REFERENCE SIGNS LIST

10 far-infrared radiation multi-stage type heating furnace
13-1 to 13-6 heating unit
14-1 to 14-7 far-infrared radiation heater
15-1 to 15-6 steel sheet for hot stamping
16*a* to 16*f* block made of a thermal insulation material
19 ceiling unit
26 first metal strip
27 support piece
30 to 34 steel sheet support member

The invention claimed is:

1. A far-infrared radiation multi-stage type heating furnace comprising heating units and steel sheet support members, at least one of the heating units comprising:

blocks comprising a thermal insulation material, each of the blocks being disposed around a respective horizontal plane of a respective space having rectangular outer shape for accommodating one of the steel sheets for hot stamping; and far-infrared radiation heaters positioned above and below one of the steel sheets for hot stamping to heat one of the steel sheets for hot stamping, the steel sheet support members being disposed within the heating units to support one of the steel sheets for hot stamping, the far-infrared radiation heating furnace further comprising support pieces that support the steel sheet support members in such a manner that the steel sheet support members are expandable and contractible in a longitudinal direction by thermal expansion or thermal contracts on, the blocks comprising a pair of fixed blocks extending parallel straight and facing each other in a horizontal direction and sandwiching the space in the horizontal plane, a fixed base block sandwiched between lower side of the pair of fixed blocks, a cover block arranged to be opened and closed to open and close an inlet or an outlet of the space that the steel sheet is passed through for hot stamping, and arranged to contact and be sandwiched between upper side of the pair of fixed blocks in a closed position, and the cover block disposed on the fixed base block and directly exposed to an area over the heating unit in the closed position, and the cover block with horizontal length between the pair of fixed blocks at least three times its vertical length.

2. The far-infrared radiation multi-stage type heating furnace according to claim 1, wherein each of the far-infrared radiation heaters comprises a planar structure comprising a plurality of insulator elements arranged in rows, the insulator elements comprising sintered form of far-infrared radiation emitting ceramics, and wherein the plurality of insulator elements are coupled together by a heating wire so as to be capable of being displaced from each other so that the far-infrared radiation heater has flexibility, the heating wire being inserted in heating wire through holes formed in the respective insulator elements.

3. The far-infrared radiation multi-stage type heating furnace according to claim 1, wherein the steel sheet support members comprise a heat resistant alloy.

4. The far-infrared radiation multi-stage type heating furnace according to claim 2, wherein the steel sheet support members comprise a heat resistant alloy.

5. The far-infrared radiation multi-stage type heating furnace according to claim 1, wherein the steel sheets for hot stamping comprise aluminum-coated steel sheets or zinc-coated steel sheets, and wherein the steel sheet support members support the steel sheets for hot stamping by point contact or line contact with the steel sheets for hot stamping.

6. The far-infrared radiation multi-stage type heating furnace according to claim 2, wherein the steel sheets for hot stamping comprise aluminum-coated steel sheets or zinc-coated steel sheets, and wherein the steel sheet support members support the steel sheets for hot stamping by point contact or line contact with the steel sheets for hot stamping.

7. The far-infrared radiation multi-stage type heating furnace according to claim 3, wherein the steel sheets for hot stamping comprise aluminum-coated steel sheets or zinc-coated steel sheets, and wherein the steel sheet support members support the steel sheets for hot stamping by point contact or line contact with the steel sheets for hot stamping.

8. The far-infrared radiation multi-stage type heating furnace according to claim 4, wherein the steel sheets for hot stamping comprise aluminum-coated steel sheets or zinc-coated steel sheets, and wherein the steel sheet support members support the steel sheets for hot stamping by point contact or line contact with the steel sheets for hot stamping.

9. The far-infrared radiation multi-stage type heating furnace according to claim 5, wherein the steel sheet support members that provide a point contact with the steel sheets for hot stamping comprise rectangular tubes, strips or round tubes, disposed laterally and standing vertically and each having upright pins on a surface thereof, or round tubes having a wire wound around a outer circumferential surface thereof.

10. The far-infrared radiation multi-stage type heating furnace according to claim 6, wherein the steel sheet support members that provide a point contact with the steel sheets for hot stamping comprise rectangular tubes, strips or round tubes, disposed laterally and standing vertically and each having upright pins on a surface thereof, or round tubes having a wire wound around a outer circumferential surface thereof.

11. The far-infrared radiation multi-stage type heating furnace according to claim 7, wherein the steel sheet support members that provide a point contact with the steel sheets for hot stamping comprise rectangular tubes, strips or round tubes, disposed laterally and standing vertically and each having upright pins on a surface thereof, or round tubes having a wire wound around a outer circumferential surface thereof.

12. The far-infrared radiation multi-stage type heating furnace according to claim 8, wherein the steel sheet support members that provide a point contact with the steel sheets for hot stamping comprise rectangular tubes, strips or round tubes, disposed laterally and standing vertically and each having upright pins on a surface thereof, or round tubes having a wire wound around a outer circumferential surface thereof.

13. The far-infrared radiation multi-stage type heating furnace according to claim 5, wherein the steel sheet support members that provide a line contact with the steel sheets for hot stamping comprise rectangular bars or strips, disposed laterally and standing vertically and each having an acute angle portion on a surface thereof.

14. The far-infrared radiation multi-stage type heating furnace according to claim 6, wherein the steel sheet support members that provide a line contact with the steel sheets for hot stamping comprise rectangular bars or strips, disposed laterally and standing vertically and each having an acute angle portion on a surface thereof.

15. The far-infrared radiation multi-stage type heating furnace according to claim 7, wherein the steel sheet support members that provide a line contact with the steel sheets for hot stamping comprise rectangular bars or strips, disposed laterally and standing vertically and each having an acute angle portion on a surface thereof.

16. The far-infrared radiation multi-stage type heating furnace according to claim 8, wherein the steel sheet support members that provide a line contact with the steel sheets for hot stamping comprise rectangular bars or strips, disposed laterally and standing vertically and each having an acute angle portion on a surface thereof.

17. The far-infrared radiation multi-stage type heating furnace according to claim 9, wherein the upright pins formed on the upper surface and lower surface of the steel sheet support members.

18. The far-infrared radiation multi-stage type heating furnace according to claim 10, wherein the upright pins formed on the upper surface and lower surface of the steel sheet support members.

19. The far-infrared radiation multi-stage type heating furnace according to claim 11, wherein the upright pins formed on the upper surface and lower surface of the steel sheet support members.

20. The far-infrared radiation multi-stage type heating furnace according to claim 12, wherein the upright pins formed on the upper surface and lower surface of the steel sheet support members.

21. The far-infrared radiation multi-stage type heating furnace according to claim 1, wherein the support pieces support the steel sheet support members where the steel sheet support members are slidable with respect, to the support pieces or/and the support pieces are slidable with respect to the fixed blocks to expand and contract the steel sheet support members in the longitudinal direction of the steel sheet support members by thermal expansion or thermal contraction.

* * * * *